US010171899B2

(12) United States Patent
Hsu

(10) Patent No.: US 10,171,899 B2
(45) Date of Patent: Jan. 1, 2019

(54) SOUND LIGHT AND SOUND COMBINATION

(71) Applicant: Dong Guan Bright Yinhuey Lighting Co., Ltd., Guang Dong (CN)

(72) Inventor: Kevin Hsu, Taichung (TW)

(73) Assignee: Dong Guan Bright Yinhuey Lighting Co., Ltd., Guang Dong (CN)

( * ) Notice: Subject to any disclaimer, the term of this patent is extended or adjusted under 35 U.S.C. 154(b) by 43 days.

(21) Appl. No.: 15/609,123

(22) Filed: May 31, 2017

(65) Prior Publication Data

US 2018/0352313 A1 Dec. 6, 2018

(51) Int. Cl.

| | |
|---|---|
| ***F21V 33/00*** | (2006.01) |
| ***H04R 1/02*** | (2006.01) |
| ***F21S 8/02*** | (2006.01) |
| ***F21V 17/12*** | (2006.01) |
| ***F21V 17/18*** | (2006.01) |
| ***F21V 19/00*** | (2006.01) |
| *F21Y 115/10* | (2016.01) |

(52) U.S. Cl.

CPC ..... *H04R 1/028* (2013.01); *F21S 8/026* (2013.01); *F21V 17/12* (2013.01); *F21V 17/18* (2013.01); *F21V 19/0035* (2013.01); *H04R 1/025* (2013.01); *F21Y 2115/10* (2016.08)

(58) Field of Classification Search

None

See application file for complete search history.

(56) References Cited

U.S. PATENT DOCUMENTS

| | | | | |
|---|---|---|---|---|
| 5,562,343 | A * | 10/1996 | Chan | F21S 8/02 362/147 |
| 5,828,765 | A * | 10/1998 | Gable | H04R 1/028 381/386 |
| 7,971,680 | B2 * | 7/2011 | Morgan, III | E04B 9/001 181/205 |
| 8,042,961 | B2 * | 10/2011 | Massara | F21V 23/0471 362/249.02 |
| 8,237,377 | B2 * | 8/2012 | Hopper | F21V 23/0435 315/291 |
| 8,666,104 | B2 * | 3/2014 | Ivey | H04R 1/028 181/141 |
| 2010/0165643 | A1 * | 7/2010 | Russo | F21V 21/04 362/365 |
| 2013/0272535 | A1 * | 10/2013 | Yuan | H04R 1/023 381/77 |
| 2014/0063823 | A1 * | 3/2014 | Miwa | F21V 19/004 362/396 |
| 2015/0124441 | A1 * | 5/2015 | Lam | F21V 33/0056 362/231 |

(Continued)

*Primary Examiner* — Tracie Y Green

(74) *Attorney, Agent, or Firm* — Alan D. Kamrath; Kamrath IP Lawfirm, P.A.

(57) ABSTRACT

A light and sound combination includes a lighting module and an audio module detachably mounted on the lighting module. The audio module includes a main body and a sounding assembly mounted in the main body. The lighting module includes a housing and an LED board mounted in the housing. Thus, the light and sound combination provides illuminating and sound playing functions by provision of the lighting module and the audio module. In addition, the audio module is detachably mounted on the lighting module, so that the audio module is mounted on and detached from the lighting module easily and conveniently.

9 Claims, 8 Drawing Sheets

(56) References Cited

U.S. PATENT DOCUMENTS

| | | | | |
|---|---|---|---|---|
| 2015/0264458 | A1* | 9/2015 | Rutherford | H04R 1/028 381/394 |
| 2015/0338077 | A1* | 11/2015 | Johnson | F21V 23/005 362/234 |
| 2016/0150135 | A1* | 5/2016 | Chen | F21V 33/0052 348/151 |
| 2016/0230969 | A1* | 8/2016 | Pelletier | F21V 23/008 |
| 2016/0255437 | A1* | 9/2016 | Wen | F21V 23/009 381/300 |
| 2016/0320007 | A1* | 11/2016 | Araki | F21S 8/026 |
| 2018/0051872 | A1* | 2/2018 | Ivey | F21V 33/0056 |

* cited by examiner

SOUND LIGHT AND SOUND COMBINATION

BACKGROUND OF THE INVENTION

1. Field of the Invention

The present invention relates to a lighting tool and, more particularly, to a light and sound combination for a ceiling fitting or a recessed light.

2. Description of the Related Art

A conventional ceiling fitting comprises a housing secured on a ceiling, a light emitting element mounted in the housing, and a lampshade mounted on the housing to cover the light emitting element. Thus, the ceiling fitting is attached the ceiling so as to provide a lighting function. However, the conventional ceiling fitting does not have a sound playing function. A conventional sound is mounted on the ceiling or the wall to provide a sound playing function. However, the conventional sound does not have an illuminating function. In addition, the conventional ceiling fitting and sound are mounted respectively, thereby occupying a larger mounting space, and thereby causing inconvenience to the user in assembly of the conventional ceiling fitting and sound. Further, the conventional ceiling fitting and sound are arranged respectively and are not integrated, thereby decreasing the aesthetic quality of the house.

BRIEF SUMMARY OF THE INVENTION

The primary objective of the present invention is to provide a light and sound combination that provides illuminating and sound playing functions simultaneously.

In accordance with the present invention, there is provided a light and sound combination comprising a lighting module and an audio module detachably mounted on the lighting module. The audio module includes a main body and a sounding assembly mounted in the main body. The main body has an outer face provided with a plurality of slideways and a plurality of locking slots corresponding to the slideways. Each of the locking slots has a substantially L-shaped profile and includes an upright section connected to one of the slideways and a transverse section connected to the upright section. The lighting module includes a housing and an LED (light emitting diode) board mounted in the housing. The housing has a bottom provided with a receiving groove and a top provided with a projection. The LED board is mounted in the receiving groove of the housing. The projection of the housing has an inner face provided with a plurality of limit blocks each locked in the transverse section of one of the locking slots.

According to the primary advantage of the present invention, the light and sound combination provides illuminating and sound playing functions by provision of the lighting module and the audio module, thereby enhancing the versatility of the light and sound combination.

According to another advantage of the present invention, the audio module is detachably mounted on the lighting module, so that the audio module is mounted on and detached from the lighting module easily and conveniently, thereby facilitating the user assembling and disassembling the light and sound combination.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
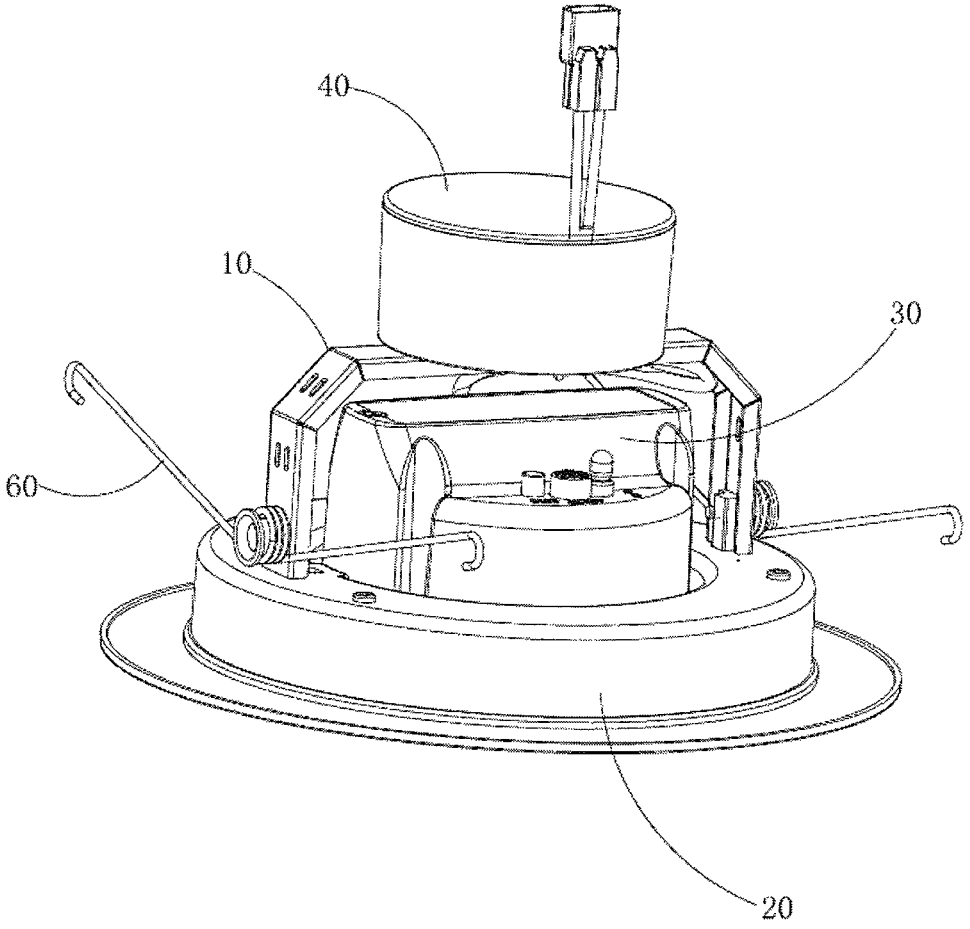
FIG. 1 is a perspective view of a light and sound combination in accordance with a preferred embodiment of the present invention.
Figure 2:
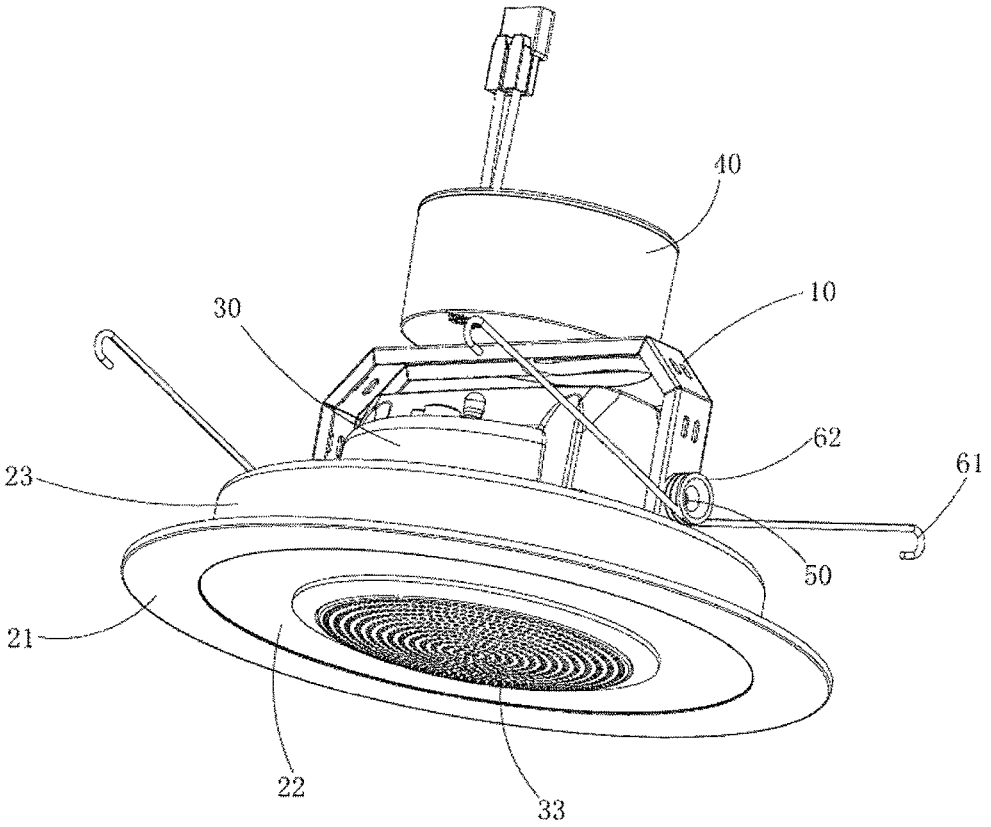
FIG. 2 is another perspective view of the light and sound combination in accordance with the preferred embodiment of the present invention.
Figure 3:
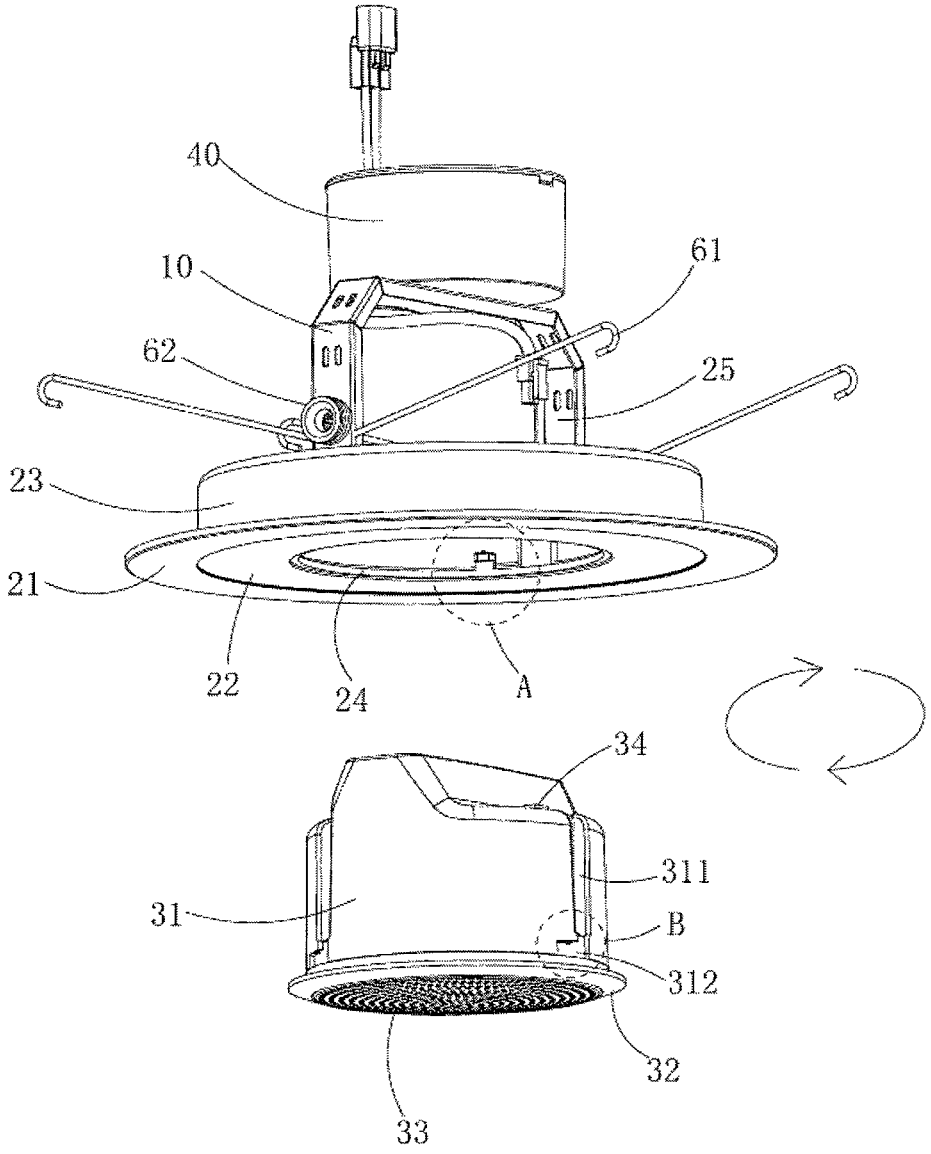
FIG. 3 is a partially exploded perspective view of the light and sound combination as shown in FIG. 1.
Figure 4:
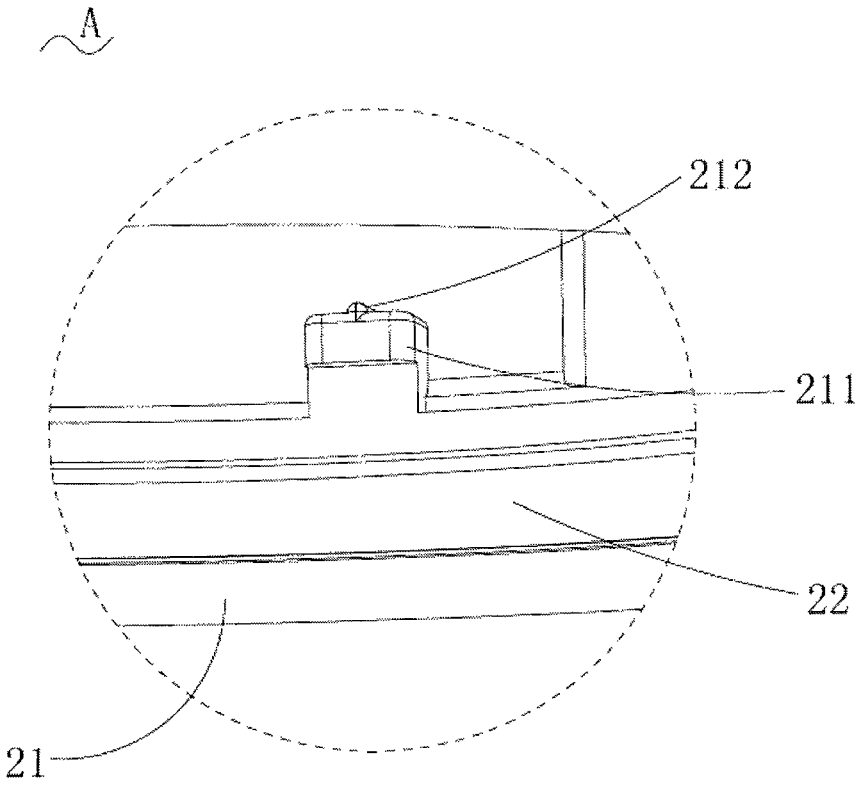
FIG. 4 is a locally enlarged view of the light and sound combination taken along a phantom circle "A" as shown in FIG. 3.
Figure 5:
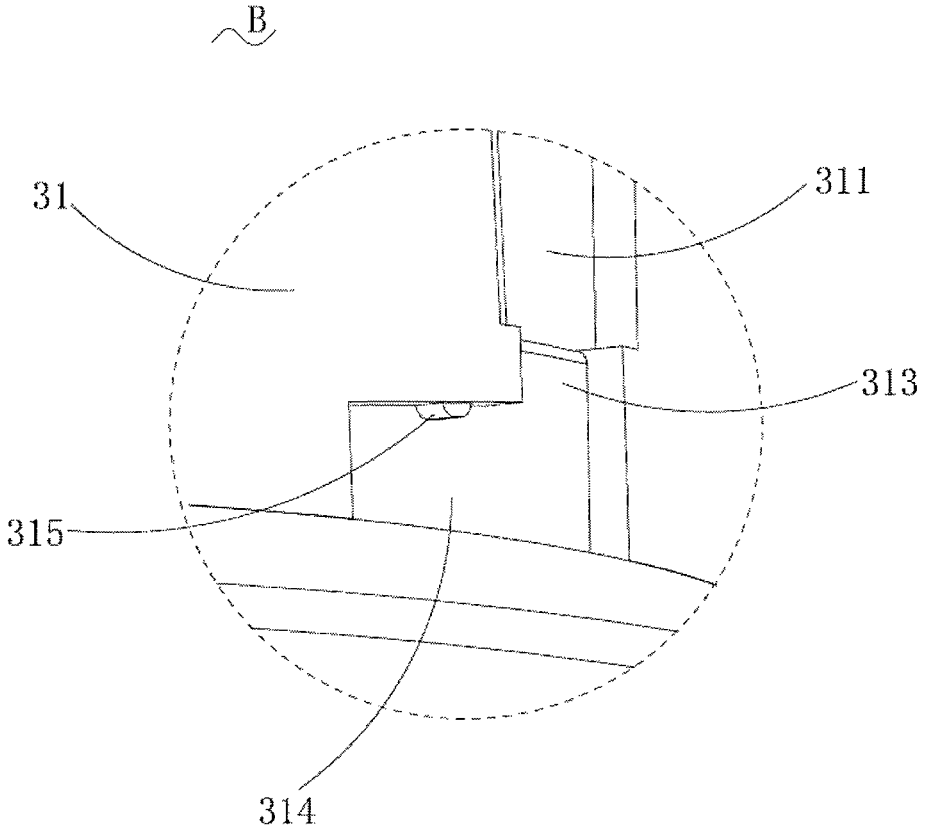
FIG. 5 is a locally enlarged view of the light and sound combination taken along a phantom circle "B" as shown in FIG. 3.

Referring to the drawings and initially to FIGS. 1-5, a light and sound combination in accordance with the preferred embodiment of the present invention comprises a lighting module 20 and an audio module 30 detachably mounted on the lighting module 20. Thus, the light and sound combination provides illuminating and sound playing functions.

The audio module 30 is mounted on a central position of the lighting module 20 and includes a main body 31, a bottom disk 32 mounted on the bottom of the main body 31, a strainer 33 sandwiched between the main body 31 and the bottom disk 32, and a sounding assembly mounted in the main body 31.

The main body 31 has an outer face provided with a plurality of slideways 311 and a plurality of locking slots 312 corresponding to and located under the slideways 311. Each of the slideways 311 extends downward from a top face of the main body 31. Each of the locking slots 312 has a substantially L-shaped profile and includes an upright section 313 connected to one of the slideways 311 and a transverse section 314 connected to the upright section 313. The bottom disk 32 is secured on the bottom of the main body 31 by a plurality of fasteners which extend through the main body 31 and the bottom disk 32. The sounding assembly includes a control button (not labeled), a switch (not labeled), a connection (not shown) and a power connector 34. The control button is used to regulate the sound volume. The control button and the switch extend through and protrude outward from the top of the main body 31. The connection is connected to an external audio arrangement by bluetooth, WiFi or other manners.

The lighting module 20 includes a housing 21, a lampshade 22 mounted on the housing 21, and an LED (light emitting diode) board mounted in the housing 21. The housing 21 has an interior provided with a receiving hole 24 for mounting the audio module 30.

The housing 21 has a bottom provided with a receiving groove and a top provided with a projection 23. The receiving groove of the housing 21 has an annular shape. The LED board is mounted in the receiving groove of the housing 21. The projection 23 of the housing 21 has an inner face provided with a plurality of limit blocks 211 each locked in the transverse section 314 of one of the locking slots 312. The limit blocks 211 of the housing 21 are arranged in an annular shape. The lampshade 22 is mounted on the bottom of the housing 21 and received in the receiving groove of the housing 21 to cover the LED board.

In the preferred embodiment of the present invention, the transverse section 314 of each of the locking slots 312 is provided with a first locking bar 315, and each of the limit blocks 211 is provided with a second locking bar 212 locked onto the first locking bar 315 of one of the locking slots 312. Preferably, the first locking bar 315 of each of the locking slots 312 has an arc-shaped cross-sectional profile.

In assembly, when the audio module 30 is inserted into the receiving hole 24 of the lighting module 20, each of the limit blocks 211 of the housing 21 extends through each of the slideways 311 into the upright section 313 of each of the locking slots 312. Then, the lighting module 20 is rotated relative to the audio module 30, so that each of the limit blocks 211 of the housing 21 is inserted into and locked in the transverse section 314 of each of the locking slots 312, and the second locking bar 212 of each of the limit blocks 211 passes and is restricted by the first locking bar 315 of each of the locking slots 312. Thus, the audio module 30 is locked onto the lighting module 20.

In the preferred embodiment of the present invention, the light and sound combination further comprises a substantially inverted U-shaped connecting bracket 10 mounted on the lighting module 20, and a power connection module 40 mounted on the connecting bracket 10 and connected with the lighting module 20 and the audio module 30 by electric wires. Preferably, the lighting module 20 is arranged on a bottom of the connecting bracket 10, and the power connection module 40 is arranged on the top of the connecting bracket 10. The power connection module 40 is connected to the power connector 34.

In the preferred embodiment of the present invention, the lighting module 20 is provided with two connecting blocks 25, and the light and sound combination further comprises two fastening screws 50 extending through the connecting bracket 10 and screwed respectively into the two connecting blocks 25, to combine the connecting bracket 10 and the lighting module 20.

In the preferred embodiment of the present invention, the light and sound combination further comprises a fixture secured on the connecting bracket 10. The fixture is used to attach the light and sound combination to a ceiling.

In the preferred embodiment of the present invention, the fixture includes two mounting members 62 mounted on the connecting bracket 10 and two springs 60 mounted on the two mounting members 62 respectively, and the two fastening screws 50 in turn extend through the two mounting members 62 and the connecting bracket 10 and are screwed respectively into the two connecting blocks 25. Each of the two mounting members 62 has a substantially T-shaped profile and extends through each of the two springs 60. Each of the two springs 60 has two ends each provided with a hooked portion 61.

Figure 6:
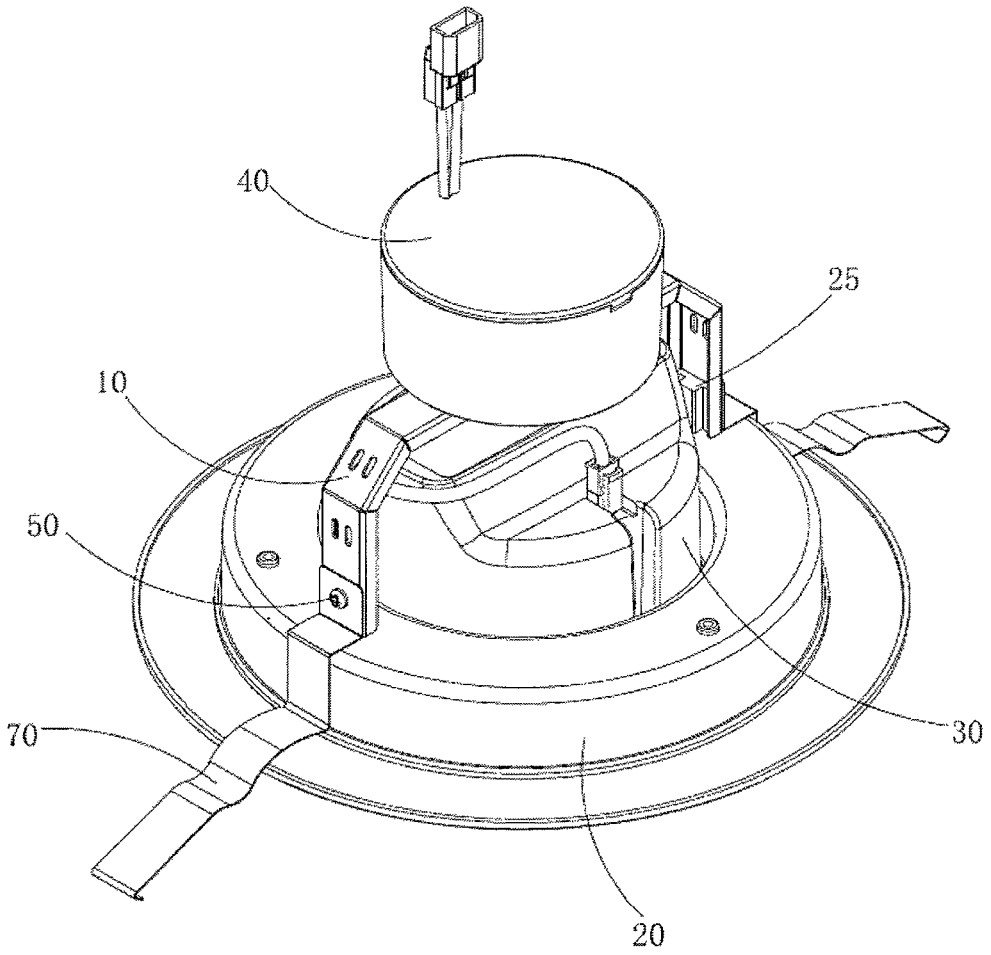
FIG. 6 is a perspective view of a light and sound combination in accordance with another preferred embodiment of the present invention.

Referring to FIG. 6, the fixture includes two elastic plates 70 mounted on the connecting bracket 10, and the two fastening screws 50 in turn extend through the two elastic plates 70 and the connecting bracket 10 and are screwed respectively into the two connecting blocks 25. The two elastic plates 70 replace the two mounting members 62 and the two springs 60.

Figure 7:
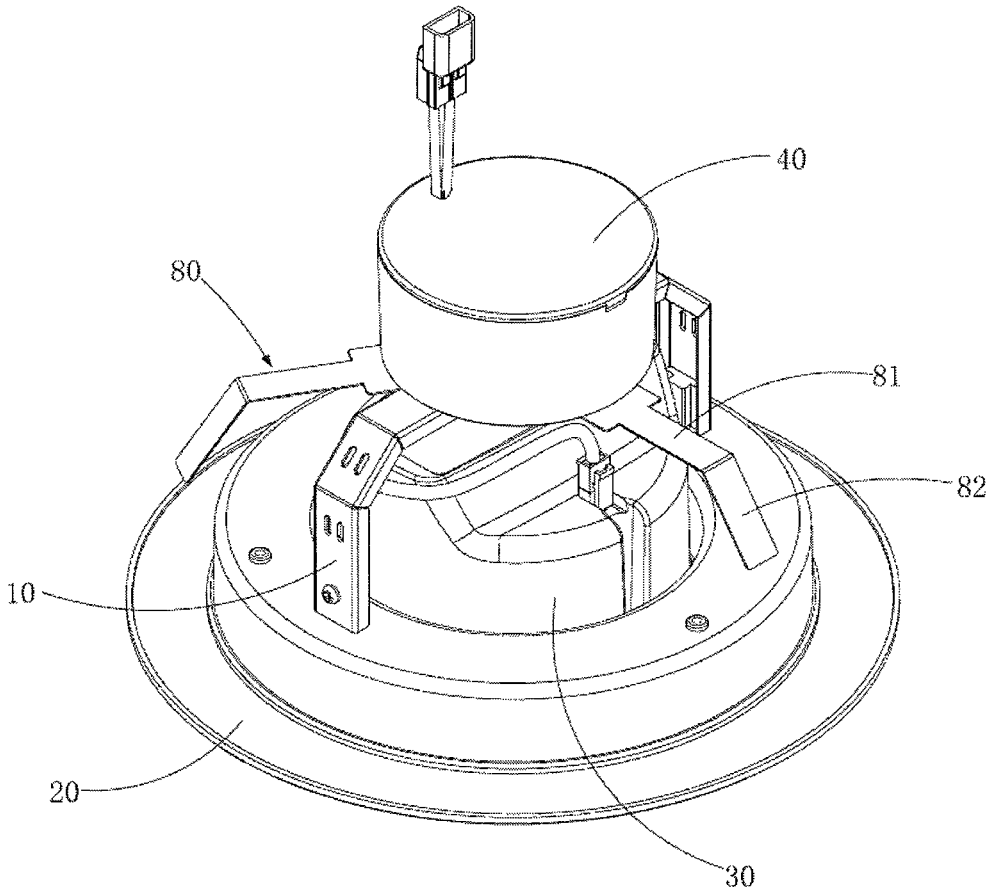
FIG. 7 is a perspective view of a light and sound combination in accordance with a further preferred embodiment of the present invention.

Referring to FIG. 7, the fixture includes two elastic plates 80 directly secured on the top of the connecting bracket 10. Each of the two elastic plates 80 has a flat section 81 extending from the connecting bracket 10 and an oblique section 82 extending from the flat section 81 and bent downward.

Figure 8:
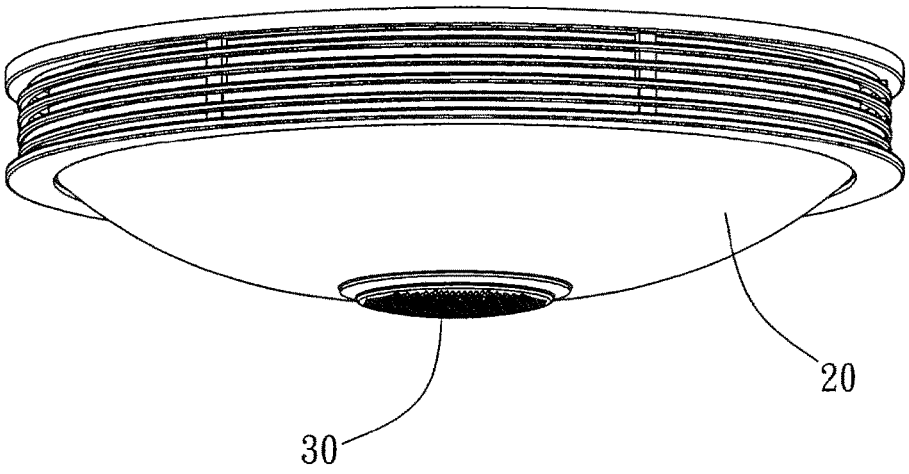
FIG. 8 is a perspective view of the light and sound combination for a ceiling fitting in accordance with the present invention.
Figure 9:
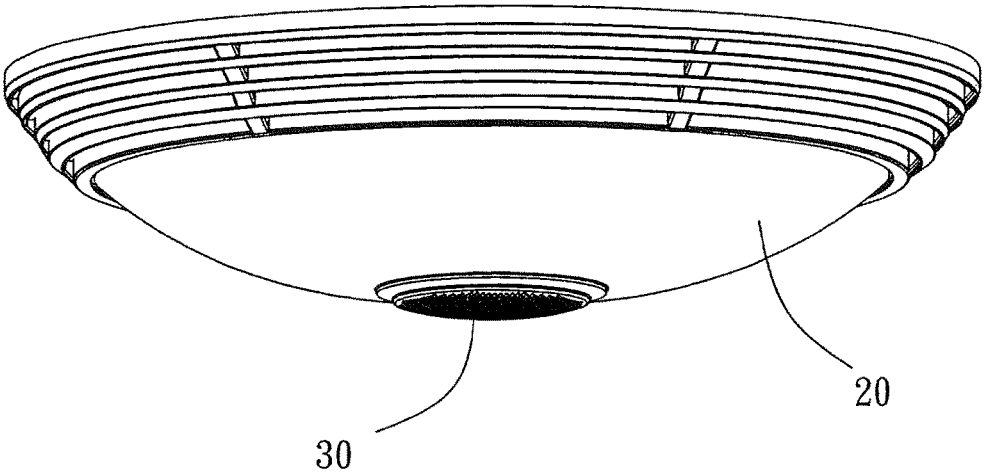
FIG. 9 is a perspective view of the light and sound combination for another ceiling fitting in accordance with the present invention.

Referring to FIGS. 8 and 9, the light and sound combination is available for a ceiling fitting or a recessed light that may be used outdoors.

In the preferred embodiment of the present invention, a plurality of the light and sound combinations are combined, wherein one of the light and sound combinations is the primary device, and the other light and sound combinations are the secondary devices. The primary device employs 2.4G or 5G to have a wireless extension. The primary device is connected with the secondary devices in a one-to-many manner. Preferably, the primary device is serially connected with the secondary devices, so that when the primary device provides an audio playing function, the secondary devices also provide the same audio playing function simultaneously.

Accordingly, the light and sound combination provides illuminating and sound playing functions by provision of the lighting module 20 and the audio module 30, thereby enhancing the versatility of the light and sound combination. In addition, the audio module 30 is detachably mounted on the lighting module 20, so that the audio module 30 is mounted on and detached from the lighting module 20 easily and conveniently, thereby facilitating the user assembling and disassembling the light and sound combination. Further, the light and sound combination has a simplified construction and saves the mounting space efficiently.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A light and sound combination comprising:

a lighting module; and an audio module detachably mounted on the lighting module;

wherein:

the audio module includes a main body and a sounding assembly mounted in the main body;

the main body has an outer face provided with a plurality of slideways and a plurality of locking slots corresponding to the slideways;

each of the locking slots has a substantially L-shaped profile and includes an upright section connected to one of the slideways and a transverse section connected to the upright section;

the lighting module includes a housing and an LED (light emitting diode) board mounted in the housing;

the housing has a bottom provided with a receiving groove and a top provided with a projection;

the LED board is mounted in the receiving groove of the housing; and the projection of the housing has an inner face provided with a plurality of limit blocks each locked in the transverse section of one of the locking slots.

2. The light and sound combination of claim 1, wherein the transverse section of each of the locking slots is provided with a first locking bar, and each of the limit blocks is provided with a second locking bar locked onto the first locking bar of one of the locking slots.

3. The light and sound combination of claim 1, further comprising:

a substantially inverted U-shaped connecting bracket mounted on the lighting module.

4. The light and sound combination of claim 3, wherein the lighting module is provided with two connecting blocks, and the light and sound combination further comprises two fastening screws extending through the connecting bracket and screwed respectively into the two connecting blocks.

5. The light and sound combination of claim 4, further comprising:

a fixture secured on the connecting bracket.

6. The light and sound combination of claim 5, wherein:

the fixture includes two mounting members mounted on the connecting bracket and two springs mounted on the two mounting members respectively;

the two fastening screws in turn extend through the two mounting members and the connecting bracket and are screwed respectively into the two connecting blocks;

each of the two mounting members has a substantially T-shaped profile and extends through each of the two springs; and each of the two springs has two ends each provided with a hooked portion.

7. The light and sound combination of claim 5, wherein the fixture includes two elastic plates mounted on the connecting bracket, and the two fastening screws in turn extend through the two elastic plates and the connecting bracket and are screwed respectively into the two connecting blocks.

8. The light and sound combination of claim 5, wherein the fixture includes two elastic plates secured on a top of the connecting bracket, and each of the two elastic plates has a flat section extending from the connecting bracket and an oblique section extending from the flat section and bent downward.

9. The light and sound combination of claim 3, further comprising:

a power connection module mounted on the connecting bracket and connected with the lighting module and the audio module.

* * * * *